United States Patent [19]

Wehrle et al.

[11] Patent Number: 4,936,797

[45] Date of Patent: Jun. 26, 1990

[54] ELECTRIC PLUG-IN CONTACT PIECE

[75] Inventors: Rudolf Wehrle, Steinhausen; Arno Dingemans, Cham, both of Switzerland

[73] Assignee: CDM Connectors Development and Manufacture AG, Cham, Switzerland

[21] Appl. No.: 342,302

[22] Filed: Apr. 24, 1989

[30] Foreign Application Priority Data

May 6, 1988 [CH] Switzerland ..... 1731/88

[51] Int. Cl.[5] ..... H01R 13/428

[52] U.S. Cl. ..... 439/751; 439/82

[58] Field of Search ..... 439/82, 751, 825–827, 439/873

[56] References Cited

U.S. PATENT DOCUMENTS

| | | | |
|---|---|---|---|
| 3,783,433 | 1/1974 | Kurtz et al. | 339/17 C |
| 4,186,982 | 2/1980 | Cobaugh et al. | 339/17 C |
| 4,585,293 | 4/1986 | Czeschka et al. | 439/82 |
| 4,691,979 | 9/1987 | Manska | 439/82 |
| 4,728,164 | 3/1988 | Lemmens et al. | 439/82 |
| 4,795,378 | 1/1989 | Tomizu et al. | 439/82 |
| 4,836,806 | 6/1989 | Dougherty et al. | 439/82 |

FOREIGN PATENT DOCUMENTS 818173 1/1975 Belgium .

*Primary Examiner*—Gary F. Paumen

*Attorney, Agent, or Firm*—Laurence R. Brown

[57] ABSTRACT

The plug-in section of this contact piece intended for a plugging into a bore in an electrical circuit plate has a substantially Y-shaped cross-section with two elastically bendable U-legs and a web interconnecting same. Seen in cross-section of the plug-in section the web has a thickness exceeding the thickness of each U-leg. At its surface facing away from the U-legs the web is provided with a rib extending in the plugging-in direction. When the plug-in section is plugged into a bore of a circuit plate the rib and the end sections of the two U-legs located at the outside thereof will contact abuttingly the circumference of the bore whereby the U-legs are bent elastically towards each other such that the contact piece attains an impeccable fit in the bore. The plug-in section is produced preferably by an extrusion molding in a molding die such that specifically sharp edges at the plugging-in section are avoided.

7 Claims, 3 Drawing Sheets

ELECTRIC PLUG-IN CONTACT PIECE

BACKGROUND OF THE INVENTION

1. FIELD OF THE INVENTION

The present invention relates to an electric contact piece intended to be plugged into a bore in an electric circuit plate and having a plug-in section of a substantially U-shaped cross-section which section is elastically yieldable laterally relative to the plug-in direction and includes two elastically bendable legs and a web interconnecting the legs. The invention relates further to a method of producing such a contact piece and to a molding tool for carrying out this method.

2. DESCRIPTION OF THE PRIOR ART

It oftentimes is necessary to connect individual conductors of an electric circuit plate to external electrical circuit components or circuit systems, i.e. such which do not belong to the respective circuit plate or board. To this end electrical contact pieces are known which are plugged into a respective bore in the circuit plate and accordingly can be mechanically mounted to the circuit plate. It is further known to provide the circumferential walls of the bores of the circuit plate which receive the contact pieces with an individual electrically conductive coating, specifically of copper including a tin plating, which coating is in connection with at least one of the conductors of the plate such that upon the plugging-in of each contact piece automatically an impeccable electrical connection between the contact piece and at least one allocated conductor of the plate is made and soldering will thus no longer be necessary.

Numerous shapes of contact pieces are already know for the plugging-in technique described. As a rule such contact pieces have the form of a pin which has a broadened plug-in section having elastically yielding properties in a direction laterally to the longitudinal axis of the pin such that a good fit of the contact piece which has been plugged-in is guaranteed when the inside diameter of the bore in the electrical circuit plate varies within prescribed tolerances.

Until now the broadened plug-in section of the contact pieces has been produced by a local splitting into two legs extending substantially parallel and spread from each other or laterally offset to each other whereto a punching or cutting technique has been used which as a rule led to sharp longitudinal edges of the plug-in section. Such sharp longitudinal edges are burdened with the drawback that during the plugging or pressing in of the contact piece they possibly may cut fine shavings out of the metallic coating on the inner circumferential wall of the bore in the circuit plate which possibly remain adhering someplace on the circuit board and may form disturbing contact bridges between conductors. In order to avoid this danger the outer longitudinal edges of the plug-in section which come into contact with the circumferential wall with the bore in the circuit plate have also been rounded whereby an additional production step during the manufacturing procedure has been necessary.

Several known contact pieces of the kind described have the further drawback that their plug-in section abuts or contacts in the plugged-in operational condition the circumferential wall of the respective bore of the circuit plate at only two outer longitudinal edges which are located roughly diametrically to each other and, therefore, does not in every case sit sufficiently stably and untiltable in the bore. Contact pieces of the kind described are disclosed e.g. in the U.S. Pat. No. 4,186,982 and in the Belgian Patent Specification BE-PS 818,173.

It is, furthermore, known to shape the plug-in section of the contact pieces by a flattening thereof by means of a pressing procedure and thereafter following rolling such that it is given a roughly horseshoe shaped, W-shaped or clover-like cross-section such as e.g. disclosed in the U.S. Pat No. 3,783,433. Such designs demand relatively complicated multistep manufacturing methods.

SUMMARY OF THE INVENTION

Hence, it is a primary object of the present invention to provide an electric contact piece intended to be plugged into an electric circuit plate which includes a plug-in section which will be seated in a bore of an electric circuit plate having an inner diameter sized within the common tolerance limits guaranteed with an impeccable stable non-tiltable fit and, during the pressing-in motion into the bore, will definitely avoid a chip removing deformation of a metal coating adhering at the inner circumferential wall of the bore.

A further object is to provide an electric contact piece wherein its plug-in section comprises a cross-sectional shape in which the web of its U-shaped cross-section has a thickness exceeding the thickness of each leg and is provided with a rib extending in the plug-in direction, further wherein the entire cross-sectional shape of the plug-in section of the contact piece is located within an imaginary circle contacting tangentially the free end surface of the rib and the two end surface zones of the two legs facing away from each other as well, which surfaces which are contacted tangentially by the imaginary circle are intended to contact and abut the inner wall surface of the bore when the contact piece is plugged thereinto, whereby the end sections of the two legs are bent elastically yieldably towards each other.

Still a further object of the present invention is to provide a suitable and relatively simple method of producing an electric contact piece intended to be pressed into a bore in an electric circuit plate and having a plug-in section of a substantially U-shaped elastically yieldable cross-section.

Yet a further object is to provide a method of producing such an electric contact piece which comprises the steps of providing a pin shaped metal piece having a solid rectangular, square or round cross-section and of producing the plug-in section by an extrusion molding in a mold which includes a die having an elongated hollow chamber for a placing thereinto said pin shaped metal piece and a punch which is movable perpendicularly to the longitudinal extent of the hollow chamber into and out of the chamber.

A further object of the present invention is to provide a molding tool which is specifically suitable for practicing the above methods.

Yet a further object is to provide a molding tool for producing an electric contact piece intended to be pressed into a bore in an electrical circuit plate, which molding tool comprises a die having an elongated hollow chamber for receipt of a pin shaped metal piece having a solid rectangular, square or round cross-sectional shape, and having further a punch movable laterally relative to the longitudinal extent of the hollow chamber into and out of said chamber.

BRIEF DESCRIPTION OF THE DRAWINGS

The present invention will be better understood and objects other than those set forth above, will become apparent when consideration is given to the following detailed description thereof. Such description makes reference to the annexed drawings wherein.

DESCRIPTION OF THE PREFERRED EMBODIMENTS

Figure 1:
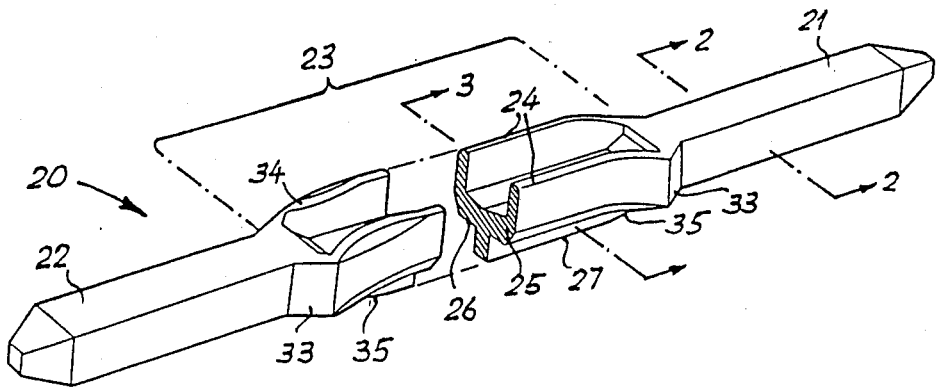
FIG. 1 is a perspective view of a first embodiment of the inventive contact piece intended to be plugged into a bore of an electric circuit plate such as a printed circuit board.
Figure 2:
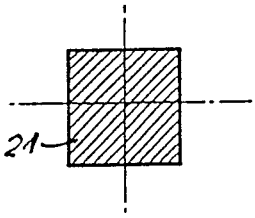
FIG. 2 is a view of a section along line 2—2 in FIG. 1 through one of the pin-shaped end sections of the contact piece according to FIG. 1 and drawn on an enlarged scale.
Figure 3:
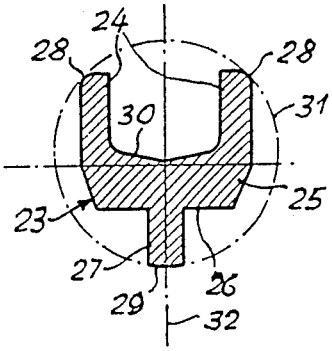
FIG. 3 illustrates a sectional view taken along line 3—3 of FIG. 1 of the plug-in section of the contact piece.

The electric contact piece 20 illustrated in FIGS. 1 to 3 has two pin like end sections 21,22 and a plug-in section 23 located therebetween and having a deformed cross-section. As can be seen in FIG. 2 the end section 21 and 22 have a rectangular, approximately square cross-section. The plug-in section 23 has a widened cross-section such as can clearly be seen in FIG. 3 when compared with FIG. 2. The profile of the cross-section of the plug-in section 23 has substantially the shape of an U. It comprises two U-legs 24 and a web 25 interconnecting same. The thickness of the web 25 exceeds the thickness of each U-leg 24 considerably. At the outer surface 26 of the web 25 facing away from the legs 24 a rib 27 is provided which extends in the longitudinal direction of the plug-in section 23. The cross-section of the end zones or sections 28 of the two legs 24 facing away from each other are of a rounded shape. The rib 27 has also an end zone or section 29 which has a rounded cross-sectional shape. The inner surface 30 of the web which faces the legs 24 extends approximately through the center of an imaginary circle 31 which encircles the cross-section of the plug-in section 23 and contacts tangentially the rounded end sections 28 and 29 of the two legs 24 and the rib 27 such as shown in FIG. 3. The complete cross-sectional shape of the plug-in section 23 is symmetrical relative to a plane 32 which extends between the two U-legs 24 and through the rib 27.

Figure 4:
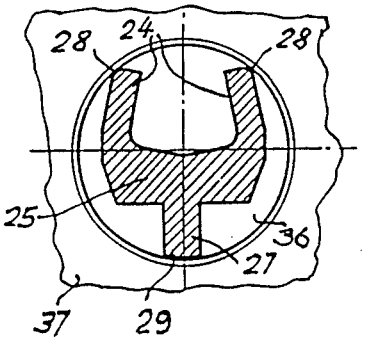
FIG. 4 illustrates a sectional view corresponding to the view of FIG. 3 for such case in which the contact piece is pressed into a bore of a circuit plate which has a diameter corresponding to the uppermost limit of the bore diameter tolerance.
Figure 5:
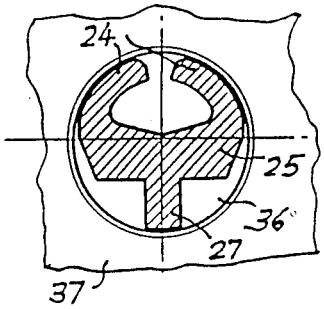
FIG. 5 illustrates a sectional view corresponding to the view of FIG. 4 show the contact piece pressed into a bore of a circuit plate which has a diameter corresponding to the lowermost limit of the bore diameter tolerance.
Figure 6:
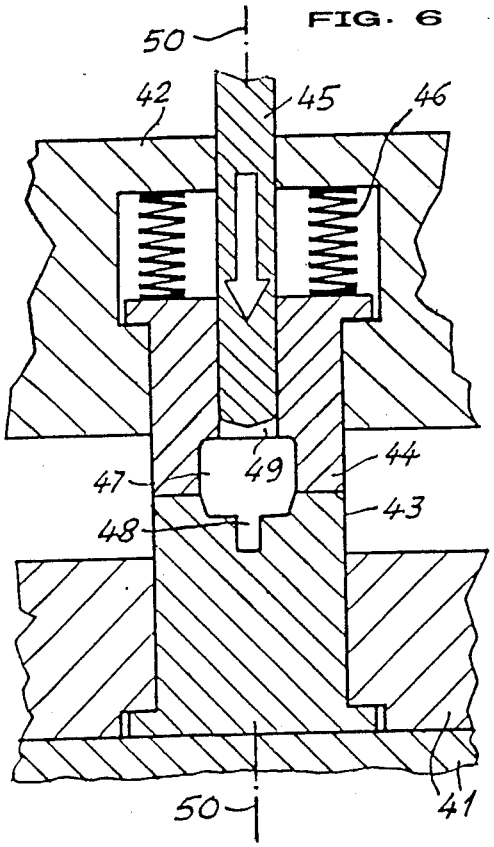
FIG. 6 is a schematical section view of apparatus having a pressing die for producing the contact piece of FIG. 1 by means of an extrusion molding method.

According to FIG. 1 obliquely extending ramped or slanted surfaces 33,34 and 35 are present at the areas of transition between the plug-in section 23 and each of the pin shaped end sections 21 and 22 respectively, which surfaces facilitate the inserting of the plug-in section into a bore 36 of a circuit plate 37 (FIGS. 4 and 5). The diameter of the bore 36 may vary within a tolerance of plus or minus about 10% of the nominal or design diameter, must, however, in any case be smaller than the diameter of the imaginary circle 31 (FIG. 3). If the diameter of the bore is at the upper limit of the tolerance the two legs 24 will be bent only relatively slightly elastically towards each other upon insertion of the plug-in section into the bore, such as illustrated in FIG. 4. If, however, the plug-in section 23 is inserted into a bore having a diameter corresponding to the lower limit of the tolerance the two legs 24 are subjected to a stronger elastical bending against each other, such as illustrated in FIG. 5. In both cases only the surface sections 28 of the legs 24 having a rounded cross-section and the end surfaces 29 of the rib 27 which have also a rounded cross-section will abuttingly contact the inner wall of the bore 36. Because the contacting surfaces 28 and 29 have no sharp edges a chip removing damaging of metal platings on the inner wall of the bore 36 is practically impossible. The inserted contact piece 20 sits with a solid non-tiltable fit in the bore because the three surface sections 28,29 abutting the inner wall of the bore 36 are distributed along the circumference of the bore. The pin shaped end sections 21 and 22 of the contact 20 serve for instance as prongs of plugs for a connecting of plug connecting pieces or as post for a mounting of lead wires by a soldering or by means of the so-called wire-wrap technique. According to not specifically illustrated embodiments the end sections of the contact piece may be designed as contact knives or contact springs.

The producing of the contact piece 20 described proceeds preferably in accordance with the method illustrated in FIGS. 6 to 9 and as described hereinafter. The shaping of the plug-in section 23 proceeds by a non-cutting extrusion molding by means of a pressing die such as illustrated schematically in FIG. 6. This pressing die includes a stationary frame 41, a pressing bar 42 which is movable upwards and downwards and a pressing mold 43,44,45. The latter consists of a bipartite die 43,44 and of a movable punch 45. One die part 43 is mounted to the frame 41 whereas the other die part 44 is movable together with the pressing bar 42 upwards and downwards. According to FIG. 6 the upper die part 44 is located in the pressure bar 24 movable against the action of springs 46, which springs 46 allow a retreating of the upper die part 44 relative to the pressure bar 42. The two die parts 43 and 44 enclose together an elongated hollow chamber 47 having a shape which corresponds to the outer shape of the plug-in section 23 of the contact piece 20 to be produced. Accordingly, the lower die part 43 includes an elongated groove 48 for the shaping of the rib 27 of the plug-in section 23. The punch 45 is guided also for an upward and downward movement in a guiding recess 49 in the upper die part 44 such that it can be moved laterally to the longitudinal direction of the hollow chamber 47 in a direction towards the groove 48 and out of the hollow chamber 47. The hollow chamber 47 and the punch 45 are symmetrical in relation to a common plane of symmetry 50.

Figure 7:
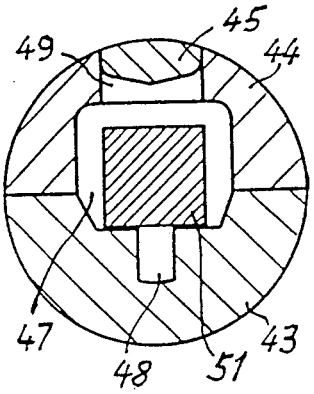
FIG. 7 illustrates on an enlarged scale, a detail of FIG. 6 together with a sectional view of a blank workpiece placed in the pressing die prior to the begin of the extrusion molding.
Figure 8:
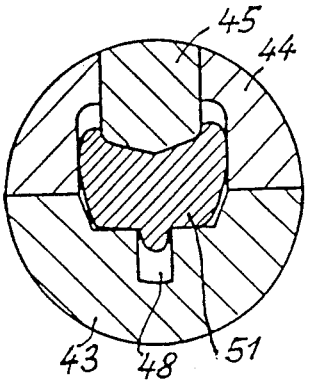
FIG. 8 is an illustration similar to the illustration of FIG. 7 of parts during the extrusion molding.
Figure 9:
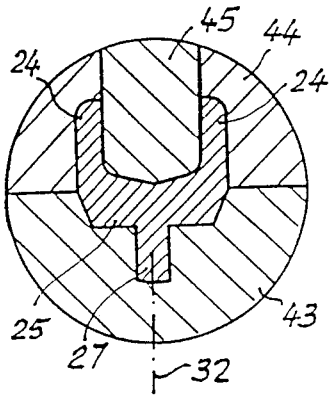
FIG. 9 is a further illustration similar to the illustration of FIG. 7 of parts at the end of the extrusion molding.

By means of the pressing die described above the plug-in piece 20 can for instance be produced as follows:

A pin shaped prismatic metal piece 51 (FIG. 7) made of a copper alloy is placed into the opened pressing mold 43,44,45 whereafter the upper die part 44 is pressed against the stationary lower die part 43 by a lowering of the pressure bar 42 such that the die 43,44 is closed, as illustrated in FIG. 7. The punch 45 is moved thereafter downwards and is pressed into the metal piece 51 such as illustrated in FIG. 8. The metal piece 51 will, thereby, be deformed by an extrusion molding such that the two U-legs 24 and the rib 27 are formed. At the end of this extrusion press molding the interstice between the three parts 43,44, and 45 of the mold is completely filled by material of the metal piece 51 such as illustrated in FIG. 9. Finally, the punch 45 and the pressing bar 42 including the upper die part 44 are moved upwards into their initial positions such to open the mold and to allow the extracting of the finished contact piece 20.

Instead of producing the contact piece 20 from a metal piece 51 having a square cross-section it may as well be produced by extrusion molding from a metal piece having a rectangular or round cross-section. In any case the end sections 21 and 22 can be shaped as desired may such be as winding posts for the wirewrap technique or as plug or as any kind of connecting member.

Figure 10:
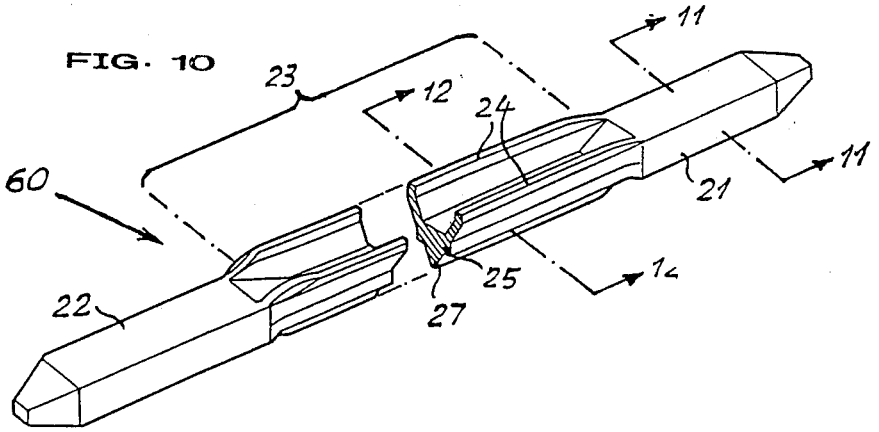
FIG. 10 is a perspective illustration of a second embodiment of the contact piece in accordance with the present invention.
Figure 11:
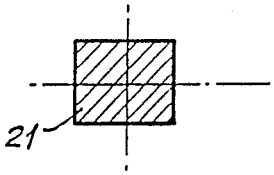
FIG. 11 is a sectional view taken along line 11—11 of FIG. 10 of one of the pin shaped end sections of the contact piece according to FIG. 10, shown on an enlarged scale.
Figure 12:
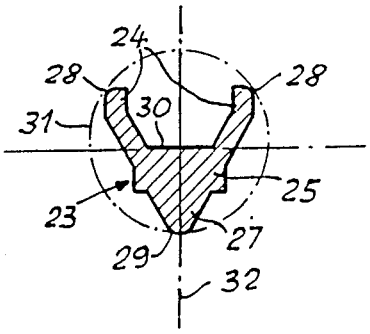
FIG. 12 is a corresponding view taken along line 12—12 of FIG. 10 of the plug-in section of the contact piece according to FIG. 10.

The second embodiment of the plug-in contact piece 20 made in accordance with the invention and illustrated in FIGS. 10 to 12 differs from the one in accordance with FIGS. 1 to 3 merely by a somewhat modified cross-sectional shape and by smaller dimensions. Whereas the first embodiment of the contact piece is intended for a plugging into a bore in a circuit plate having a diameter of e.g. 1.0±0.1 millimeters the second embodiment is suitable for a plugging into a bore having a diameter of e.g. 0.6±0.05 millimeters. The structural details of the contact piece 60 are completely analogous to these of the first embodiment 20 and are, therefore, identified in FIGS. 10 to 12 by the same reference numerals as used in FIGS. 1 to 3. There is, therefore, no need to enter once more in detail into the structural design thereof. The production of the contact piece 60 proceeds suitably by the same procedure and with a molding tool which is similar to the tool described in FIGS. 6 to 9.

Figure 13:
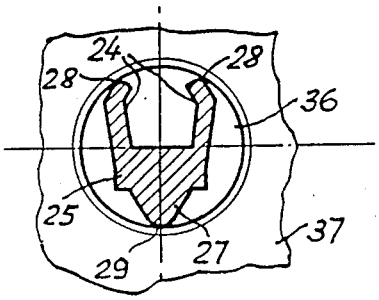
FIG. 13 is an illustration of a sectional view corresponding to the view of FIG. 12 for the case where the contact piece is pressed in a bore of a circuit plate having a diameter corresponding to the uppermost tolerance limit.
Figure 14:
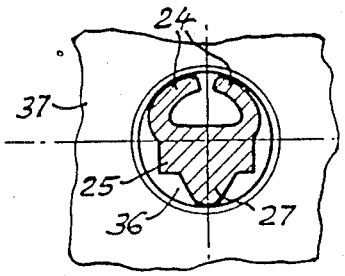
FIG. 14 is an illustration of a sectional view corresponding to the view of FIG. 12 for the case where the contact piece is pressed in a bore of a circuit plate having a diameter corresponding to the lowermost tolerance limit.

When the plug-in section 23 is plugged into a bore 36 of a circuit plate 37 the two U-legs are bent elastically yielding against each other such to provide the contact piece 60 with the necessary mechanical support on the circuit plate. If the diameter of the bore 36 corresponds to the upper tolerance limit of the design diameter the U-legs 24 attain the positions illustrated in FIG. 13. If the diameter of the bore 36 corresponds, however, to that of the lower tolerance limit, the U-legs 24 are bent further towards each other such as illustrated in FIG. 14.

Figure 15:
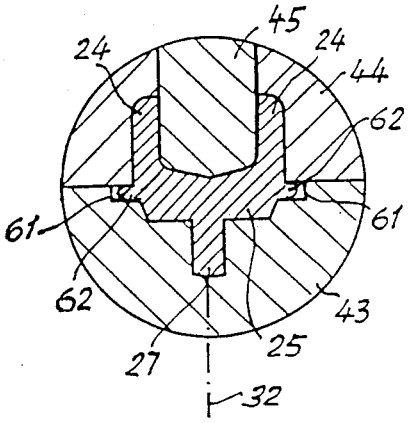
FIG. 15 is an illustration of a sectional view corresponding to the view of FIG. 9 of a variant of an embodiment of the pressing die and the contact piece which may be produced therewith.

If necessary it may be suitable to modify the extrusion molding tool used for producing the contact piece 20 and shown in FIGS. 6 to 9 such as now illustrated in FIG. 15. Accordingly, the lower die part 43 comprises at its surface facing the upper die part 44 two recesses 61 which extend each in the longitudinal direction of the hollow chamber 47 and communicate with the latter. When the die 43,44 is closed these recesses 61 form together with the upper die part 44 two groove like recesses which allow a part of the material of the plug-in section to escape laterally into the depressions formed by the recesses 61 during each final phase of the extrusion molding after the rest of the hollow chamber 47 of the die has been completely filled by the material. By means of the laterally escaping material two additional ribs 62 are produced at the plug-in section 23 of the contact piece to be produced which ribs 62 extend in the plugging-in direction of the contact piece and project away from the plane of symmetry 32 and are located each about at the transition between the web 25 and one of the U-legs 24. By a suitable selection of the width of the depressions formed by the recesses 61 as measured in the direction of movement of the punch 45 the resulting hardness of the extrusion molded material of the finally produced contact piece can be influenced and widely made to suit the demands of a given practical application.

Deviating from FIG. 9 the recesses 61 can be present as well in the upper die part 44 or in both die parts 43 and 44 instead of being provided in the lower die part 43.

While there are shown and described present preferred embodiments of the invention, it is to be distinctly understood that the invention is not limited thereto, but may be otherwise variously embodied and practiced within the scope of the following claims.

We claim:

1. An elongated electrical contact piece intended to be plugged into a bore in an electric circuit plate and having an axial plug-in section of a substantially Y-shaped cross-section which section is elastically yieldable laterally relative to an axial plug-in direction and includes two elastically bendable legs of said Y-shaped cross-section presenting two end surface zones and a web interconnecting said legs, to form together a substantially U-shaped part of the said plug-in section, said plug-in section comprising a cross-sectional shape in which said web has a thickness exceeding the thickness of each leg and is furthermore provided with a rib extending in the axial plug-in direction, said rib having an end surface forming the base of said Y-shaped cross-section for forming electrical contact with said contact piece and having a narrow width which is relatively small when compared with its radial height, so that when plugged into said bore a great surface contact pressure appears at a small width contact surface of said rib with the electrical circuit plate at said bore, further in which the entire cross-sectional shape of the plug-in section of the contact piece is located within an imaginary circle contacting tangentially the end surface of said rib and the two end surface zones of said two legs at those surfaces which are contacted tangentially by said imaginary circle for contacting and abutting the electric circuit plate defining the bore when the contact piece is been plugged into the bore, whereby the end surface zones of said two legs are bent elastically yieldably towards each other and the small width of the rib end surface is pressed into the electric plate defining the bore in a frictional contact resisting rotation of the electrical contact piece in the bore.

2. The electrical contact piece of claim 1, in which the surfaces of said two legs and of said rib which are provided for contacting with the bore are free of sharp edges.

3. The electrical contact piece of claim 1, in which said web comprises an inner surface facing said two legs which extends at least approximately through a diameter of said imaginary circle.

4. The electrical contact piece of claim 1, in which said plug-in section includes a plane of symmetry extending between said two legs and through said rib extending from the web.

5. The electrical contact piece of claim 4, in which said plug-in section comprises two additional ribs free of sharp edges and each extending in the plug-in direction, which additional ribs face away from said plane of symmetry of the plug-in section and are located each approximately in a zone between said web and one of said legs.

6. The contact piece defined in claim 1 wherein said rib has a substantially triangular cross-section defining at an apex the small width contact surface for contacting said circuit plate at said bore.

7. The contact piece defined in claim 1 wherein said rib has a substantially rectangular cross-section defining the small width contact surface for contacting said circuit plate at said bore.

* * * * *